US006533546B2

(12) United States Patent
Kreitmeier

(10) Patent No.: US 6,533,546 B2
(45) Date of Patent: Mar. 18, 2003

(54) LOW-PRESSURE STEAM TURBINE WITH MULTI-CHANNEL DIFFUSER

(75) Inventor: Franz Kreitmeier, Baden (CH)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/917,906

(22) Filed: Jul. 31, 2001

(65) Prior Publication Data

US 2002/0127100 A1 Sep. 12, 2002

(30) Foreign Application Priority Data

Jul. 31, 2000 (DE) ..... 100 37 684

(51) Int. Cl.[7] ..... F01D 25/30
(52) U.S. Cl. ..... 415/211.2; 415/221
(58) Field of Search ..... 415/208.2, 208.4, 415/211.1, 211.2, 221

(56) References Cited

U.S. PATENT DOCUMENTS 4,013,378 A * 3/1977 Herzog ..... 415/209
4,157,013 A * 6/1979 Bell, III ..... 60/39.512
5,338,155 A * 8/1994 Kreitmeier ..... 415/211.2
5,588,799 A 12/1996 Kreitmeier
5,707,208 A 1/1998 Kreitmeier

FOREIGN PATENT DOCUMENTS

| | | |
|---|---|---|
| DE | 1768637 | 6/1958 |
| DE | 1904438 | 9/1969 |
| DE | 29 53 333 | 11/1983 |
| DE | 44 22 700 | 1/1996 |
| EP | 0 265 633 | 5/1988 |
| EP | 0 581 978 | 2/1994 |

* cited by examiner

*Primary Examiner*—Ninh Nguyen
(74) *Attorney, Agent, or Firm*—Burns, Doane, Swecker & Mathis, L.L.P.

(57) ABSTRACT

An axial/radial three-channel diffuser is provided with two guide vanes for dividing the diffuser into three partial diffusers that are distributed so that the distribution of the surface area over the three partial diffusers in the inlet surface area is uneven. The guide vanes are oriented in accordance with the total pressure field after the last rotating blade row and are arranged at a minimum distance from the trailing edge of the last rotating blade row. Because of its long extension in relation to the channel heights of the partial diffusers, the three-channel diffuser brings about a gentle deflection of the diffuser flow. The diffuser according to the invention results in an improved pressure recovery and increased turbine performance.

18 Claims, 5 Drawing Sheets

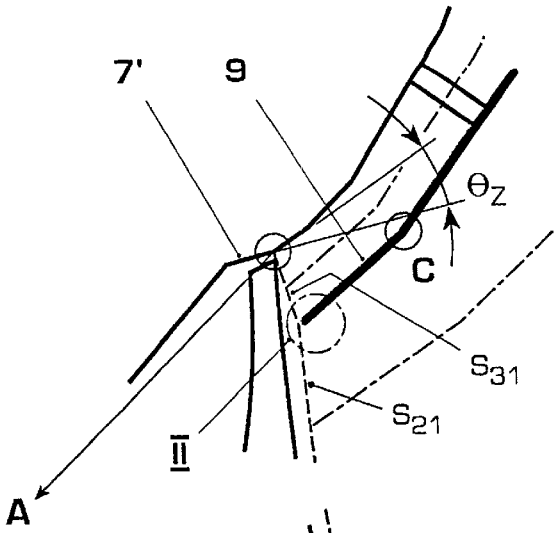
Fig. 1a
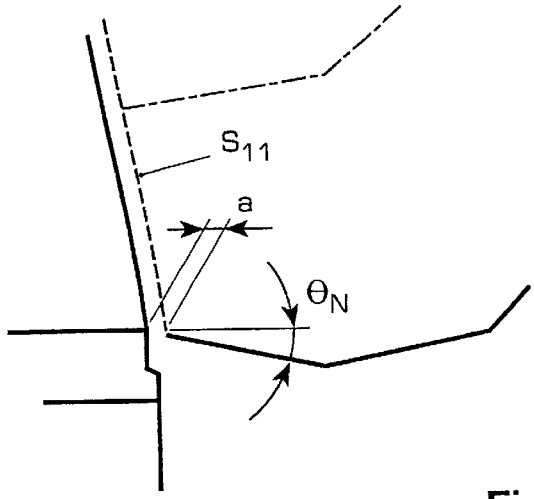
Fig. 1b
Fig. 2
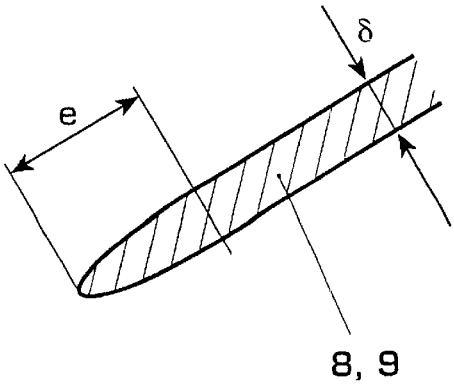
Fig. 3
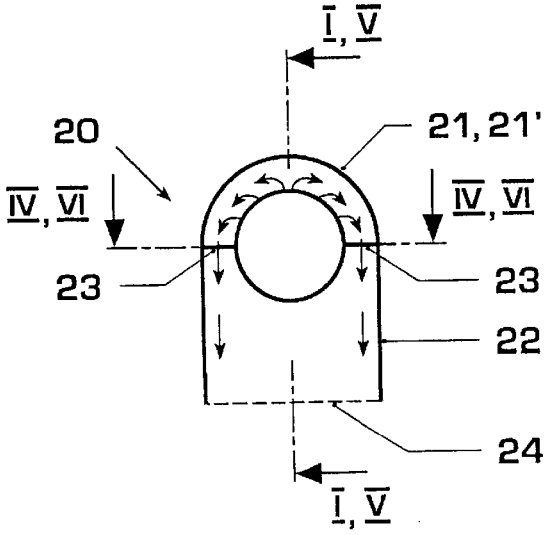

LOW-PRESSURE STEAM TURBINE WITH MULTI-CHANNEL DIFFUSER

FIELD OF THE INVENTION

The invention relates to an axial-flow low-pressure steam turbines and to axial/radial multi-channel diffuser and waste steam housing for guiding the waste steam from the blades with few losses.

BACKGROUND OF THE INVENTION

A diffuser of this type is described in DE 44 22 700. The diffuser disclosed in this document is provided after the last row of rotating blades of a low pressure steam turbine with an axial flow inlet and a radial flow outlet. The diffuser is designed with respect to optimized turbine performance by way of the greatest possible pressure recovery. For this purpose, the first partial pieces of the inner and outer diffuser ring each are oriented in relation to the hub or, respectively, the blade carrier, with an inflexion angle. This measure serves to homogenize the total pressure profile above the channel height of the diffuser in the area of the last row of rotating blades. The diffuser furthermore is provided with a radially outward curved guide plate that divides it into an inner and an outer channel. Hereby flow ribs impacted by the flow either radially or diagonally have been provided in the outer and inner channel. The guide plate is used both for deflecting and guiding the waste stream. The flow ribs have the purpose of supporting the guide plate and, in particular, reduce the spin in the delay zone, so that they also contribute to an optimization of the pressure recovery. However, realized flow ribs only are able to achieve optimum spin reduction with a specific operating load. At a different operating load, the spin reduction is not necessarily optimized. A diffuser with this kind of measure therefore only achieves optimum pressure recovery at a certain operating load. The flow ribs and their attachment to the guide plates furthermore are associated with relatively high construction expenditure. In addition, the supersonic gap flow interferes with the remaining subsonic flow.

EP 581 978, especially in FIG. 4 of this publication, discloses a multi-channel waste gas diffuser for an axial-flow gas turbine with axial flow inlet and radial flow outlet. This multi-channel diffuser is provided with three zones along its length. The first zone is constructed in the manner of a bell diffuser and extends as one channel from the last row of rotating blades to the outlet plane of several flow ribs. Here also, the diffuser rings are provided with inflexion angles that have been established so that the total pressure profile is homogenized. Downstream from the flow ribs, the second zone has flow-guiding guide rings that form several channels. The third zone is used for a major deflection of the waste gas flow in radial direction and then merges with the chimney of the gas turbine. For this purpose, the guide rings of the second zone are extended across the length of the third zone, whereby they are curved there. The second zone has a minor deflection yet high diffuser effect; the third zone a major deflection, yet has a very moderate diffuser effect.

SUMMARY OF THE INVENTION

It is the objective of the present invention to create, for a low-pressure steam turbine, an axial/radial multi-channel diffuser with waste steam housing that, in comparison to diffusers according to the state of the art, achieves an improved steam recovery, thus increasing the effectiveness of the low-pressure steam turbine. In addition, the multi-channel diffuser should be simultaneously optimized for as many operating conditions of the steam turbine as possible and should be associated with reduced construction expenditure. Finally, the waste steam housing should be adapted to the diffuser with respect to turbine performance.

This objective is realized with an axial/radial three-channel diffuser with an exhaust steam housing. The three-channel diffuser is provided with three partial diffusers, i.e., an inner, middle, and outer partial diffuser, which are formed by an inner diffuser ring, and outer diffuser ring, and two guide vanes provided between the diffuser rings. A first partial piece of the inner diffuser ring is hereby arranged in relation to the hub at an inflexion angle oriented inward, towards the rotor axis, and a first partial piece of the outer diffuser ring is arranged at an inflexion angle oriented outward in relation to the blade channel at the level of the last row of rotating blades, away from the rotor axis.

In the axial/radial three-channel diffuser according to the invention, in particular, the two guide plates extend across the entire length of the diffuser. They are unevenly distributed between the inner and outer diffuser ring, so that the distribution of the surface area over the three partial diffusers in the inlet surface area of the diffuser is uneven. In the inlet plane, the majority of the inlet surface area hereby is part of the inner and middle partial diffuser, and a small part of the inlet surface area is part of the outer partial diffuser. Furthermore, the starting tangents of the two guide plates, together with the limits of the blade channel on the hub side and housing side, which approximate each other in a straight line, form an at least approximately common intersection point above the end stage of the low-pressure steam turbine in the meridian plane. Finally, the guide plates are located as close as possible to the last row of rotating blades, whereby the distance between the last rotating blade row and the leading edges of the guide plates are determined by the minimum distance that is permissible for all operating conditions.

This describes the characteristics of the diffuser in its interaction zone with the last stage.

The diffusion zone of the diffuser is characterized by the following characteristics.

The ratio of the outlet surface area to the inlet surface area of the individual partial diffusers is greater than 2 for the middle partial diffuser and smaller than 2 for the outer partial diffuser. For the inner partial diffuser, the corresponding geometric surface area ratio ranges from 1.5 to 1.8.

Furthermore, for the middle partial diffuser, the ratio of its length to its channel height in the inlet surface area is at least equal to 4. For the outer partial diffuser, the ratio of length to channel height in the inlet surface area is at least equal to 10, and for the inner partial diffuser, the corresponding ratio is at least equal to 2.5. Based on these relatively high length to channel height ratios, the deflections of the partial diffusers are accordingly relatively small.

The ratio of the outlet surface area to the inlet surface area of the diffuser overall is approximately 2.

Finally, the waste steam housing of the diffuser is designed so that the size of the surface area of the dividing plane between the top and bottom half of the waste steam housing is adapted to the size of the outlet surface areas of the partial diffusers.

The two guide plates hereby are used to divide the diffuser channel into three partial diffusers in which the blade waste flow is guided. The resulting flow guidance is hereby the better, the more partial diffusers are present for the same overall diffuser. In contrast, the more guide plates are provided, the more friction losses and obstructions are created. The number chosen here, i.e., three partial diffusers and two guide plates, has the advantage that optimized flow guidance is achieved with justifiable friction losses at the guide plate surface areas and obstructions.

The guide plates and partial diffusers bring about a guidance and stabilization of the blade waste flow as well as a deflection into a radial direction. Since the guide plates extend over the entire length of the diffuser, this guidance is further supported.

The radial extension of the partial diffusers furthermore is used to naturally reduce the tangential speed. Because of this, the partial diffusers are optimized for all operating conditions with respect to a reduction of the tangential speed. The construction expenditure for the guide plates is also rather low, and the reduction of the tangential speed does not require any further constructive measures, such as deflection and flow ribs.

The flow guidance and stabilization is further brought about, in particular, by distributing the diffuser inlet surface area over the three partial diffusers. A majority of the inlet surface area is part of the inner and middle channel, so that the majority of the flow is guided from the blades to the waste steam housing. The smaller part of the inlet surface area is part of the outer channel, through which the supersonic gap flow as well as the flow from the turbine influenced by the gap flow is taken up and is deflected meridionally and is guided, shielded from the majority flow, to the waste steam housing. This shielding prevents flow interferences between the majority flow and the high-energy gap flow that would interfere with the diffuser effect.

The minimum distance between the last row of blades and the leading edges of the guide plates further promotes an optimal shielding of the gap flow and prevention of flow interferences and streamline convergences.

The ratio of length to channel height of each partial diffuser of 2.5 or more enables a gentle deflection from the axial or diagonal to the radial flow direction, which prevents separation of the delayed flow even at a ratio of outlet surface area to inlet surface area of 1.6.

The guidance and stabilization of the blade waste flow through the three partial diffusers, the shielding of the high-energy gap flow as well as the gentle deflection based on the length of the channels in relation to their channel heights overall achieve a homogenization and reduction of the total pressure profile at the level of the last row of rotating blades. The resulting added performance results in an increased efficiency of the low-pressure steam turbine.

The design of the diffuser according to the invention is based on a reverse design process, during which the existing flow fields are determined first. Then the respective ideal flow fields are calculated from this, and the geometry of the diffuser is determined based on these ideal flow fields. In particular, this three-channel diffuser has been designed at limit load conditions. At the limit load, a flow field, for which a three-channel diffuser with an orientation of the starting tangent of its guide plates according to the invention achieves the highest pressure recovery, was determined. It was established experimentally, that the geometry resulting from this design is superior to the state of the art diffusers over the entire operating range. This design furthermore has the advantage that a higher turbine performance is achieved with the same condenser pressure, or that the same turbine performance is achieved with a higher condenser pressure, so that a smaller, cheaper cooling system is required for the steam turbine.

Special embodiments of the invention below disclose additional, special characteristics of the interaction zone of the diffuser.

In a first, special embodiment of the invention, the starting tangents of the guide plates are in an angle range around the first inflexion point of the guide plates and around a reference starting tangent that extend at least approximately through the first inflexion point of the guide plate and through the inflexion point of the blade channel limits that approximate each other in a straight line.

In another special embodiment of the invention, the outer partial diffuser accounts for a part of the entire flow inlet surface area of the diffuser in the range from 10–12%. Of the remaining inlet surface area, 55–60% is distributed to the inner partial diffuser, 30–35% to the middle partial diffuser.

In another embodiment, the distance between the leading edges of the guide plates and the trailing edge of the last rotating blade accounts for 4% of the entire height of the rotating blade row.

In another embodiment, the leading edges of the guide plates are constructed with a profile at the flow inlet of the diffuser, resulting in a gentle acceleration at the inlet into the partial diffusers.

In additional embodiments, the diffusion zone of the diffuser is characterized as follows.

The guide plates each are carried by struts or supports extending from the inner and outer diffuser ring to the two guide plates. The middle partial diffuser remains free from any supports and therefore has minimal flow interference and losses.

In another, special construction of the waste steam zone of the diffuser, a waste steam metal plate is arranged in a radial extension at the end of the guide plate between the inner and outer partial diffuser. This waste steam guide plate achieves a better flow distribution in the waste steam housing, so that flow losses are minimized and the condenser is supplied more evenly.

BRIEF DESCRIPTION OF DRAWINGS

Preferred embodiments of the invention are described with reference to the accompanying drawings, in which FIG. 1*a* is a detail view of the interaction zone of the diffuser on the cylinder side, FIG. 1*b* is a detail view of the interaction zone of the diffuser on the hub side, FIG. 2 is a detail cross-section of the profiled leading edges of the guide plates at the diffuser inlet, FIG. 3 is a cross-section through a waste steam housing of the diffuser.

DETAILED DESCRIPTION OF THE INVENTION

Figure 1:
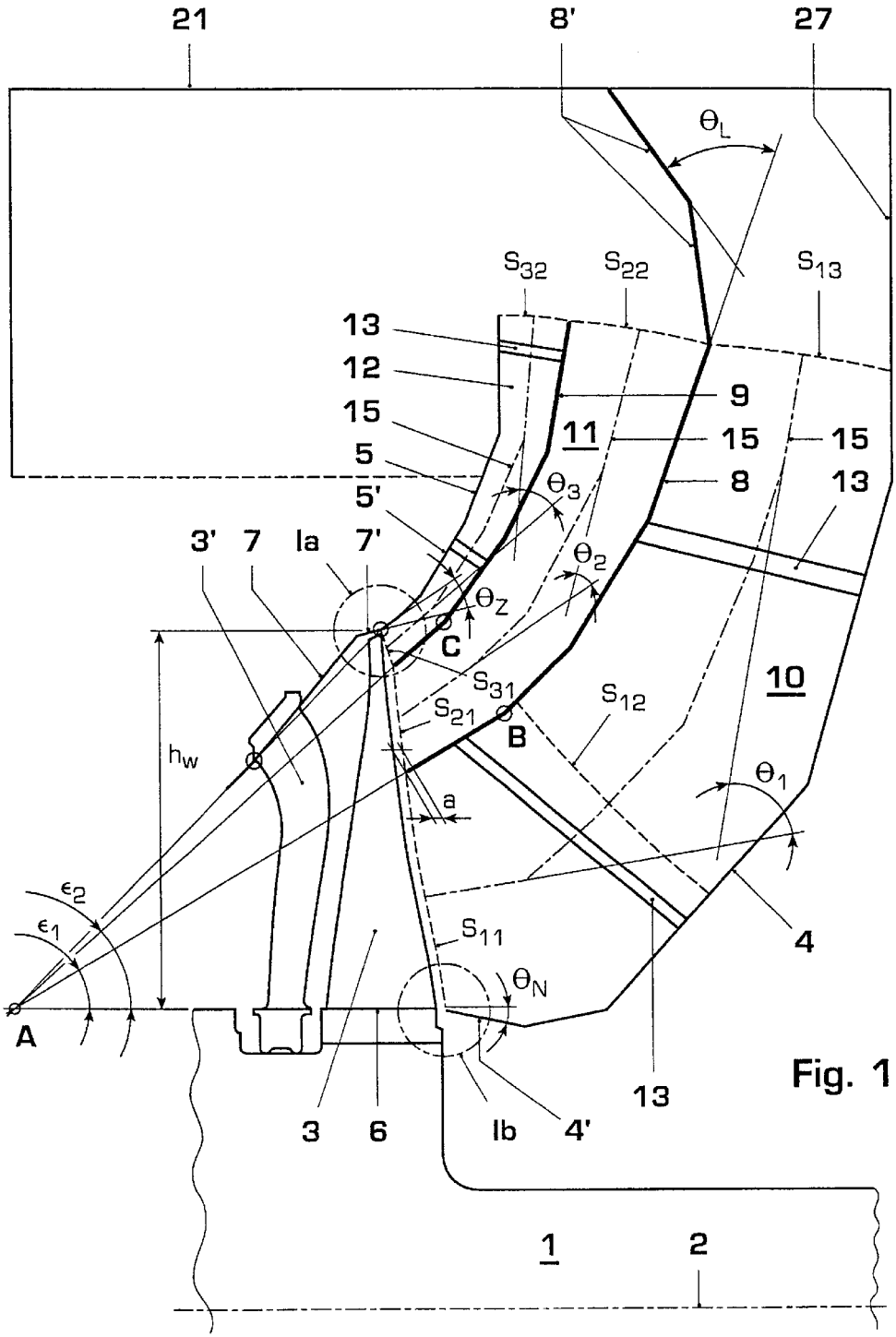
FIG. 1 is a vertical cross-section of a diffuser with a waste steam housing according to the invention.

FIG. 1 shows a three-channel diffuser as part of a low pressure steam turbine. It guides the blade exhaust flow into a exhaust steam housing 20. Of the low pressure steam turbine, the rotor 1 with rotor axis 2 and a rotating blade 3 of the last row of rotating blades is shown. An inner diffuser ring 4 and an outer diffuser ring 5 limit the three-channel diffuser. The outer diffuser ring 5 is connected to the blade carrier 7. The inner and outer diffuser rings 4 and 5 are provided in the surface area of the trailing edge of the rotating blade 3 with an inflexion angle $\theta_N$ or, respectively, $\theta_Z$, whereby, as shown in FIGS. 1*a* and 1*b*, the angle $\theta_N$ is formed by the first partial piece 4' of the inner diffuser ring 4 and an extension of the hub 6, and the angle $_Z$ is formed by the extension of the last partial piece 7' of the blade carrier 7 and the first partial piece 5' of the outer diffuser ring 5. These inflexion angles are, for example, 10–20° and help to create the most homogeneous total pressure profile at the outlet of the last row of rotating blades.

The diffuser is provided on its inside with two guide plates 8 and 9 that divide the diffuser into three partial channels: one inner partial diffuser 10, one middle partial diffuser 11, and one outer partial diffuser 12. The guide plates are hereby carried by supports 13 that extend from the inner and outer diffuser rings 4 and 5 to the guide plates. For stability reasons, the supports 13 located first in the direction of the flow are thicker than the second supports and have been constructed with a round cross-section. The middle partial diffuser 10 is, in particular, free of any supports.

The guide plates are distributed over the channel height of the diffuser with consideration of the total pressure profile in such a way that a surface area distribution over the three partial channels that is optimized with respect to flow mechanics is achieved. The first guide plate 8 is arranged so that the inner partial diffuser 10 has a flow inlet surface area that is, for example, approximately 60% of the flow inlet surface area of the diffuser overall. The second guide plate 9 is arranged furthermore so that the middle partial diffuser 11 has a flow inlet surface area that is, for example, approximately 30% of the flow inlet surface area overall. In this way, the majority of the total inlet surface area goes to the two first channels 10 and 11. The outer partial diffuser 12 in contrast has a flow inlet surface area of, for example, approximately 10% of the flow inlet surface area overall.

The diffuser outlet surface area has been designed so that the ratio of the outlet surface area to the inlet surface area of the diffuser overall, i.e., of its upper and lower half, is approximately 2.

For the individual partial diffusers, the geometrical ratios of outlet to inlet surface area are as follows.

For example, for the inner partial diffuser 10, the ratio of outlet surface area S12 in the upper half of the diffuser to the inlet surface area S11 is approximately 1.3.

The ratio of outlet surface area S13 in the lower half of the diffuser is greater to the inlet surface area S11 and is approximately 1.6. The outlet surface area S13 of the inner partial diffuser 10 is therefore located further outward in the lower half of the diffuser than in the upper half. (It has been designated in this figure and in FIG. 4 with S13, even though it is actually located in the bottom half of the diffuser.)

For the middle partial diffuser 11, the ratio of the outlet surface area S22 to inlet surface area S21 is approximately 2.1.

For the outer partial diffuser, the ratio of the outlet surface area S32 to inlet surface area S31 is approximately 3.3. Such surface area ratios are the condition for being able to significantly increase the effectiveness of the turbine.

With respect to a gentle guidance of the flow, the diffuser has been designed with a slight curvature in relation to the channel height. For this reason, the three partial diffusers have a high length-to-channel height ratio. For the inner partial diffuser 10, this is, for example, greater than 2.7 in the lower half of the diffuser. For the middle and outer partial diffuser 11 and 12, the ratios in the shown example are greater than 4.4 or, respectively, greater than 12. Because of manufacturing technology, the inner and outer diffuser rings as well as the two guide plates have several straight partial pieces in their cross-section, which, because of the high length-to-channel height ratios, are located at slight tilt angles to each other. These slight tilt angles permit improved guidance of the flow coming from the blades. This prevents, in particular, flow interferences and flow separations. Because of the relatively large radial extension of the diffuser and partial diffusers, a natural reduction of the tangential speeds without help from additional flow ribs or other measures for reducing the tangential speeds is also achieved.

Because of their radial extension, the three partial diffusers have a gentle deflection. The total deflection of each partial diffuser is designed with the angles $\theta_1$, $\theta_2$, and $\theta_3$ in the center line 15 of the individual partial diffusers 10, 11 or, respectively, 12. These angles are, for example, approximately 70°, 36°, or, respectively, 47°.

The guide vanes 8 and 9 are approximately constructed so that the extension of the starting tangents forms the intersection point A. Hereby the limits of the blade channel on the hub side and on the housing side, which approximate each other in a straight line, also runs through this intersection point A. In the shown exemplary embodiment, the starting tangents of guide vanes 8 and 9 are oriented relative to the rotor axis 2 at angles $\epsilon_1$ or, respectively, $\epsilon_2$. In different embodiments of the invention, the intersection point A between the limits of the blade channel on the hub side and on the housing side, which approximate each other in a straight line, over the end stage of the turbine, and the starting tangents of the guide vanes 8 and 9 form an at least approximately common intersection point. In the embodiments, the starting tangent of the guide plate 8 encloses an angle in the range from $\epsilon_1$+8° with the limit on the hub side that is approximated in a straight line. The starting tangent of the guide plate 9 correspondingly forms an angle in the range of $\epsilon_2$±4°.

This geometric design of the guide plates in relation to the limits of the blade channel also applies to other housing contours and blade types, for example, for completely conical, straight housing contours, for housing contours in which the partial piece above the last row of rotating blades extends cylindrically or almost cylindrically. This geometry furthermore not only can be used for rotating blades with tip seal, but also for rotating blades with cover bands. In this case, the housing-side limit of the blade channel runs through the intersection point of the trailing edge of the last rotating blade and the cover band.

In a real design of the invention, the starting tangents of guide plates 8, 9 are in an angle range around the first intersection points B and C of the guide plates 8 or 9 and around the reference tangents that run through the intersection points B or, respectively, C, and through the intersection point A.

In the shown example, the diffuser rings 4 and 5 and the guide plates 8 and 9 comprise several straight partial pieces that are placed together at small angles of tilt to each other. Instead of partial pieces, continuously curved guide plates and diffuser rings also can be realized.

The partial diffusers 10 and 11 are arranged so that a main part of the flow flows off from the blades through these two partial diffusers into the waste steam housing 20. A stable guidance of the main flow part is hereby the most susceptible to obstructions in the range of the middle partial diffuser because of the mach values occurring there. The middle partial diffuser 11 that is free from any supports therefore guides this part of the main flow without additional interference.

In contrast, the high-energy, supersonic gap flow from the last row of rotating blades reaches the outer partial diffuser 12, whereby the latter's channel height is determined in relation to the gap flow present. The gap flow is guided through the outer partial diffuser 12, separately from the main part of the flow, into the waste steam housing 20.

The high length-to-channel height ratios bring about a stabilization of the diffuser flow and homogenization as well as reduction of the total pressure profile at the level of the last row of rotating blades. This increases the pressure recovery of the diffuser and achieves an increase in the efficiency of the low-pressure steam turbine overall.

At the inlet to the diffuser, the guide plates 8 and 9 extend close to the row of rotating blades. Preferably, they are arranged as close as the axial, thermal movements of the rotating blade row and the safety distance necessary for the different operating conditions allow, without causing contact. For example, the distance a between the leading edges of the guide plates 8 and 9 and the trailing edge of the last rotating blades 3 accounts for 4% of the total height $h_W$ of the last row of rotating blades.

The leading edges of the guide vanes 8 and 9 are also constructed with profiles in order to permit a gentle flow entrance with the smallest possible overspeeds into the partial diffusers. As shown in FIG. 2, the leading edges are, for example, shaped slightly tapered, for example according to the shape NACA 65, whereby the profiling length e is three times the thickness δ. The guide vanes are also constructed as thin as possible so that the mach numbers are increased slightly, if possible. To achieve this, their thickness is, for example, approximately 5% of the channel height of the middle partial diffuser 11.

The as small as possible distance between the leading edges of the guide plates 8 and 9 and the rotating blade row 3 as well as the gentle profiling of the leading edges are a decisive factor for increasing the pressure recovery. If the guide plates are arranged at a greater distance, sound fields and flow interferences may result that would make a pressure recovery in this surface area impossible.

A exhaust steam guide plate 8' is arranged in a radial extension at the guide plate 8 between the inner and middle partial diffuser in the shown embodiment. This exhaust steam guide plate 8' achieves an improvement of the flow in the exhaust steam housing 20 and a homogenization of the flow in the condenser. The exhaust steam guide plate 8' has a gentle total deflection $\theta_L$ of approximately 50°. In this exemplary embodiment, this deflection is realized with two partial pieces whose ratio of total length to channel length in the outlet plane is approximately 0.7.

FIG. 3 shows a cross-section through the waste steam housing 20 with an upper half 21 and lower half 22 that are separated from each other by a dividing plane 23. The turbine steam that flows through the outlet surface area of the upper half of the diffuser into the upper half 21 of the waste steam housing 20 then flows down through the dividing plane 23 into the lower half 22, and from there through the outlet surface area 24 of the waste steam housing into the condenser connected there.

The waste steam housing has been adapted to the diffuser in such a way that the outlet surface area 24 of the waste steam housing 20 is approximately 15% greater than the total outlet surface area of the diffuser. This ensures a surface area reserve in the dividing plane for any obstructions of the outgoing flow.

Figure 4:
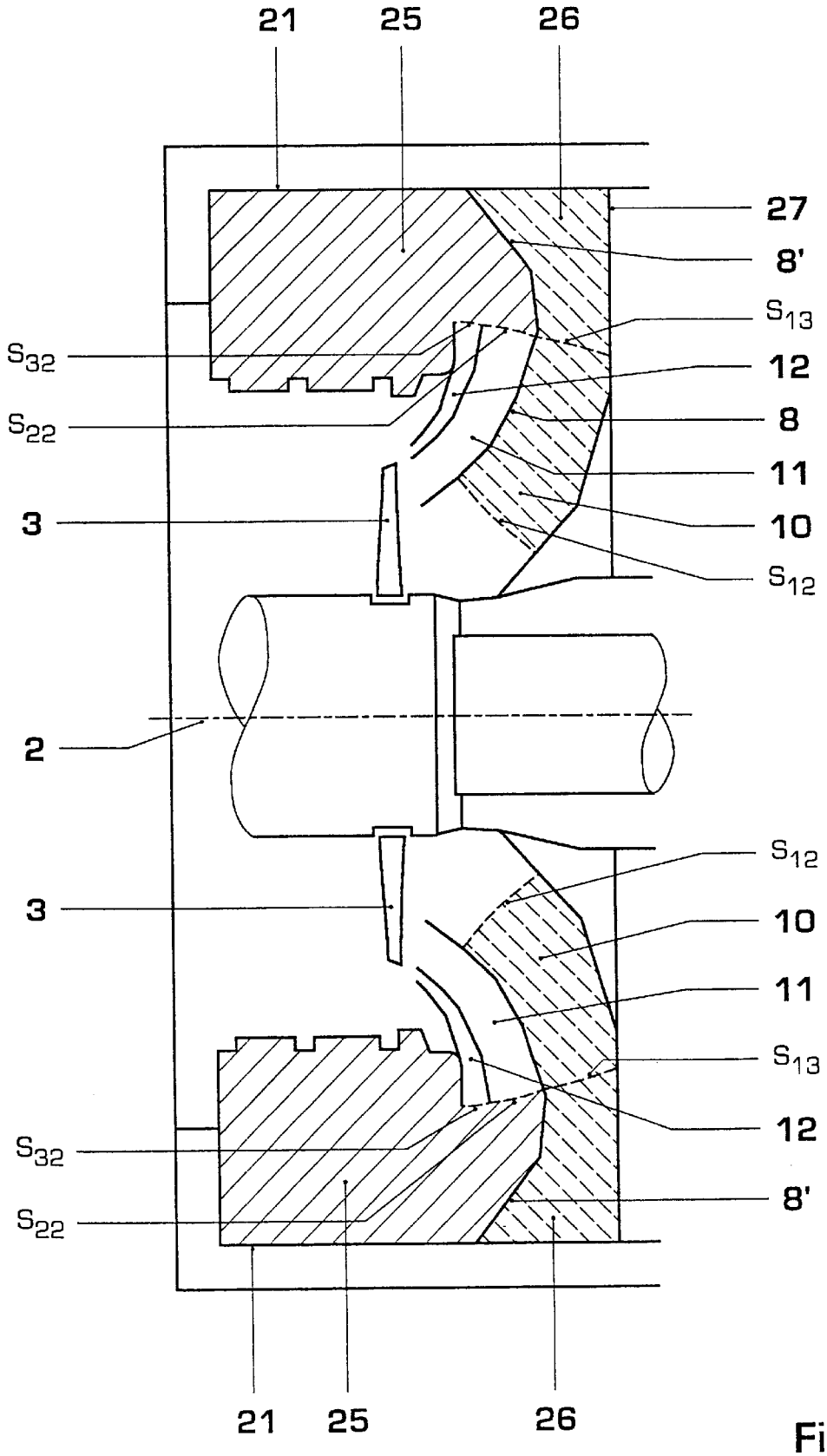
FIG. 4 is a cross-sectional view along the dividing plane between the upper and lower half of the diffuser.

According to FIG. 4, the sum of the outlet surface areas of partial diffusers 11 and 12 of the upper half of the diffuser corresponds approximately to the surface area 25 in the dividing plane 23 that is formed between the waste steam housing and the waste steam guide plate 8' of the guide plate 8 and that is shown striated with continuous lines in the figure. This means that half of the sum of the outlet surface areas S22 and S32 of the partial diffusers 11 or, respectively, 12 over the entire rotation of the diffuser equals the dividing plane surface area 25 that is striated in the figure. In addition, half of the outlet surface area S12 of the inner guide plate 10 across the entire rotation of the diffuser equals the surface area 26 that is shown striated with broken lines. As a result of the adaptation of these surface areas, the outgoing diffuser flow of partial diffusers 11 and 12 has, if possible, an equal-sized flow-through surface area and no bottlenecks when flowing from the diffuser into the waste steam housing. This again has a positive effect on the pressure recovery.

Figure 5:
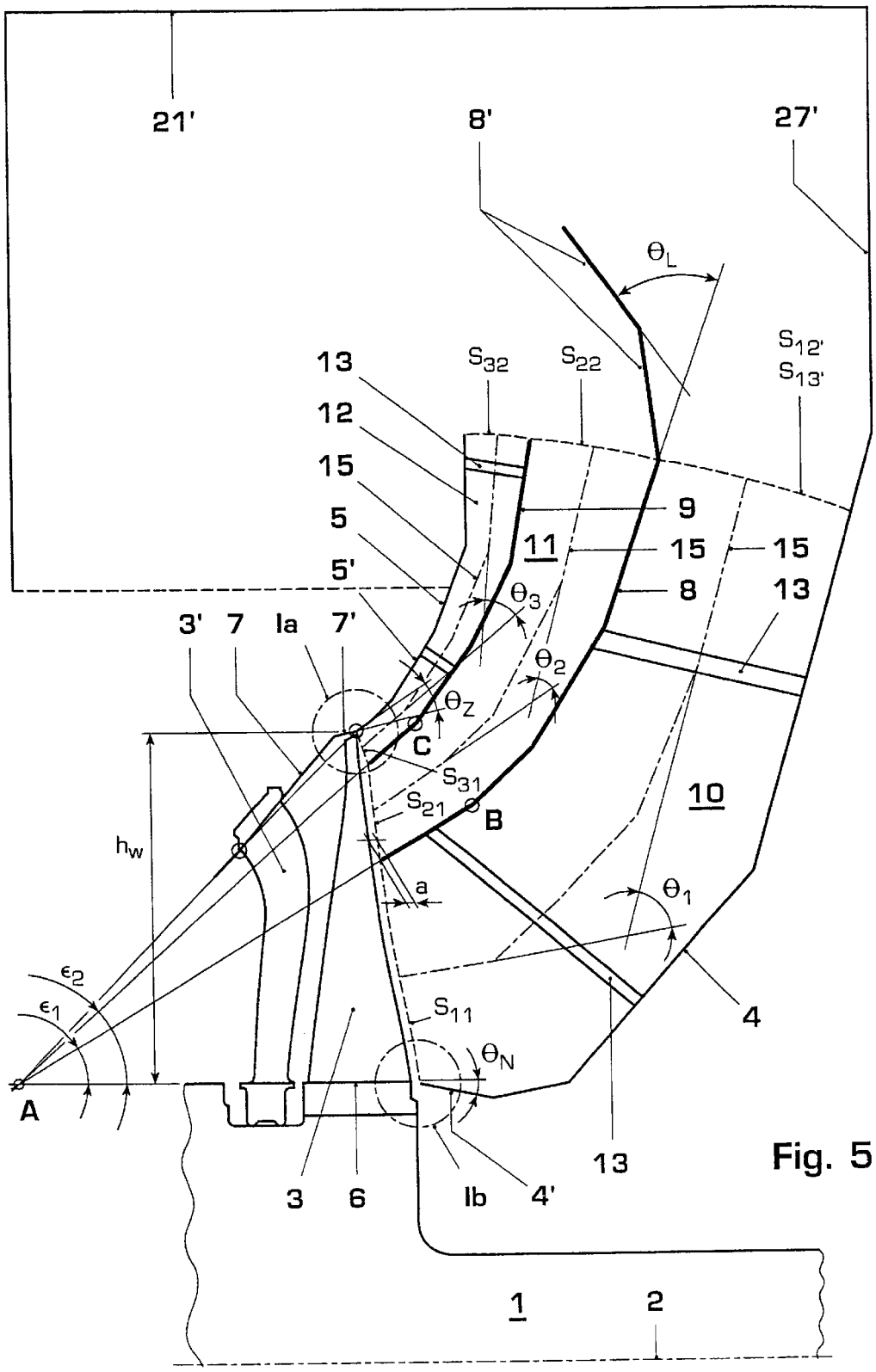
FIG. 5 is a vertical cross-section of another embodiment of the diffuser with waste steam housing, according to the invention.

FIG. 5 shows an embodiment of the three-channel diffuser according to the invention with exhaust steam housing, which has been optimized in comparison with the configuration of FIG. 1. The optimized diffuser with exhaust steam housing has been designed, in particular, with respect to the inner partial diffuser, in such a manner that the outlet surface area S12' of the inner partial diffuser 10 has been defined further outward than in the configuration shown in FIG. 1. If the outlet surface area S12' is located further outward than indicated with the striated line, the ratio of outlet surface area to inlet surface area of the respective partial diffuser is increased, and the efficiency of the turbine correspondingly rises. For this purpose, the outlet surface area S12' is defined so that the ratio of its surface area to the inlet surface area S11 is increased to approximately 1.8, which is a significant increase compared to the ratio of approximately 1.3 in the embodiment shown in FIG. 1. In order to continue to ensure a flow-through surface area with the most equal size possible from the diffuser into the exhaust steam housing, the wall 21' or hood of the upper half of the exhaust steam housing is placed radially further outward than the wall 21 of the exhaust steam housing in FIG. 1. At the same time, the impact wall 27' of the exhaust steam housing is placed axially further outward. In comparison to the deflection angle in FIG. 1, the deflection angle $\theta_1$ then is decreased to approximately 60°.

Figure 6:
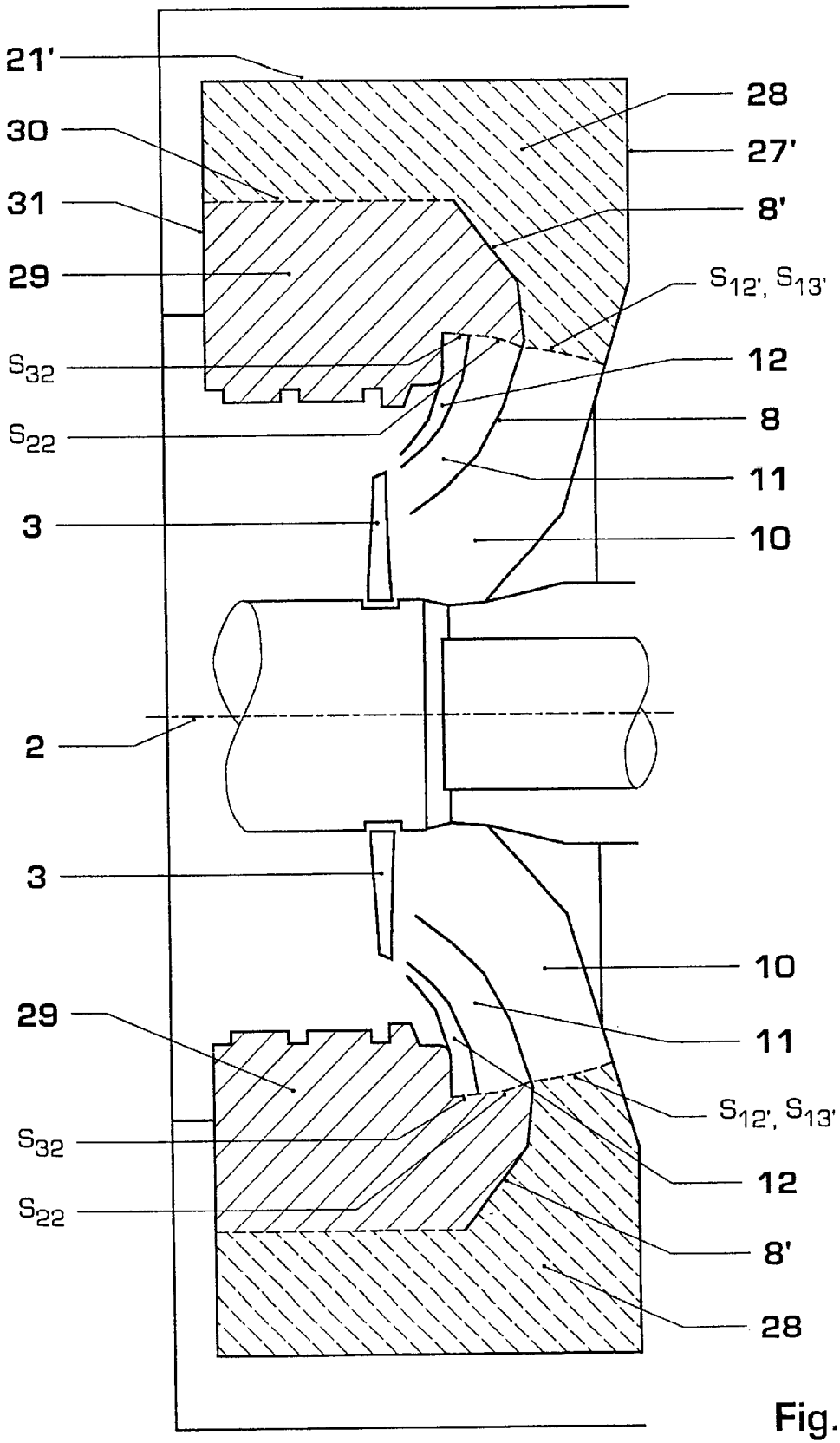
FIG. 6 is a cross-sectional view along the dividing plane between the upper and lower half of the embodiment of FIG. 5.

FIG. 6 shows this embodiment in the dividing plane 23 between the upper and lower half of the diffuser. It also shows how the dimensions of the waste steam housing and the sizes of the outlet surface areas of the partial diffusers are adapted to each other. The diffuser is designed so that half of the outlet surface area S12' of the inner partial diffuser 10 approximately equals the surface area 28 shown striated with broken lines in the dividing plane 23 between the upper and lower half of the diffuser over the entire rotation of the diffuser. The surface area 28 is formed by the impact wall 27' arranged axially further outward, the hood 21' arranged radially further outward, a wall 31 facing the turbine, and the waste steam guide plate 8'. The surface area 28 then is closed by a fictitious, axially extending line 30 between the waste steam guide plate 8' and wall 31.

The sum of the outlet surface areas S22 and S32 of the two other partial diffusers is furthermore approximately equal to the surface area 29 in the dividing plane that is striated with continuous lines. This surface area 29 is formed by the waste steam guide plate 8', the line 30, the wall 31.

In addition, the outlet surface area S13' in the lower half of the diffuser in this case coincides with the same point as the outlet surface area S12' for the upper half of the diffuser.

What is claimed is:

1. An axial/radial three-channel diffuser with an exhaust steam housing for a low pressure steam turbine, which guides the blade exhaust steam into the exhaust steam housing, the diffuser comprising an inner diffuser ring, an outer diffuser ring, and two guide vanes that divide the diffuser into an inner partial diffuser, a middle partial diffuser, and an outer partial diffuser, the inner diffuser ring being arranged in relation to a hub of the low pressure steam turbine at an inflexion angle ($\theta_N$), and the outer diffuser ring in relation to a last partial piece of a blade carrier of the low pressure steam turbine at an inflexion angle ($\theta_Z$), wherein the two guide vanes extend over the entire length of the diffuser, and the two guide vanes are distributed between the inner diffuser ring and the outer diffuser ring in such a manner that the surface areas over the three partial diffusers in the inlet surface area is different, a majority of the flow inlet surface area of the diffuser overall is part of the inner and middle partial diffuser, and a small part of the flow inlet surface area of the diffuser overall is part of the outer partial diffuser, wherein starting tangents of the guide vanes, together with the limits of a last stage blade channel on the hub side and on the housing side that approximate each other in a straight line, form an at least approximately common intersection point (A).

2. The axial/radial three-channel diffuser as claimed in claim 1, wherein the ratio of the outlet surface area (S22) to the inlet surface area (S21) of the middle partial diffuser is at least 2, the ratio of the outlet surface area (S32) to the inlet surface area (S31) of the outer partial diffuser is at least 3, and the ratio of the outlet surface area (S12) to the inlet surface area (S11) of the inner partial diffuser is at least in the lower half of the diffuser in the range form 1.5 to 1.8.

3. The axial/radial three-channel diffuser as claimed in claim 2, wherein for each of the inner partial diffuser, the middle partial diffuser, and the outer partial diffuser, at least in a lower half of each diffuser, the ratio of its length to its channel height in the inlet plane is at least 2.7, respectively 4.4, and respectively 12, wherein the lower half of each diffuser is an area below a horizontal dividing plane through a rotor axis.

4. The axial/radial three-channel diffuser as claimed in claim 3, wherein the ratio of the total outlet surface area to the total inlet surface area of the three-channel diffuser is approximately 2.

5. The axial/radial three-channel diffuser as claimed in claim 4, wherein the inlet surface area (S11) of the inner partial diffuser is 55–60%, the inlet surface area (S21) of the middle partial diffuser is 30–35%, and the inlet surface area (S31) of the outer partial diffuser is 10–12% of the total inlet surface area of the diffuser.

6. The axial/radial three-channel diffuser as claimed in claim 5, wherein the starting tangents of the guide vanes are in an angle range of 8° around the first inflexion points (B, C) of the guide vanes and around a reference starting tangent that extends through the first inflexion points (B, C) of the guide vanes and through the inflexion point (A) of the end stage blade channel limits on the hub side and the housing side that approximate each other in a straight line.

7. The axial/radial three-channel diffuser as claimed in claim 6, wherein the distance (a) between the leading edges of the guide vanes and the trailing edge of the last rotating blade accounts for approximately 4% of the total height ($h_W$) of the row of rotating blades.

8. The axial/radial three-channel diffuser as claimed in claim 7, wherein the leading edges of the guide vanes are constructed with a profile.

9. The axial/radial three-channel diffuser as claimed in claim 8, wherein the guide vanes are carried by supports that extend from the inner diffuser ring and outer diffuser ring to the guide vanes and have an increasing diameter downstream, and that the middle partial diffuser is free of any supports.

10. The axial/radial three-channel diffuser as claimed in claim 9, wherein an exhaust steam guide plate is arranged in a radial extension at the guide plate between the inner partial diffuser and the middle partial diffuser.

11. The axial/radial three-channel diffuser as claimed in claim 10, wherein the guide vanes have a thickness ($\delta$) that corresponds approximately to 5% of the channel height of the middle partial diffuser.

12. The axial/radial three-channel diffuser as claimed in claim 11, wherein the size of the outlet surface area of the exhaust steam housing in the dividing plane between the upper half and lower half of the exhaust steam housing is adapted to the size of the outlet surface areas (S12, S22, S32) of the partial diffusers.

13. The axial/radial three-channel diffuser as claimed in claim 12, wherein the sum of the outlet surface area (S22) of the middle partial diffuser and the outlet surface area (S32) of the outer partial diffuser approximately corresponds to the surface area in the dividing plane between the upper and lower half of the diffuser formed between the hood of the exhaust steam housing and the exhaust steam guide plate between an inner partial diffuser and the middle partial diffuser.

14. The axial/radial three-channel diffuser as claimed in claim 13, wherein the outlet surface area (S12) of the inner partial diffuser in the upper half of the diffuser has a ratio of approximately 1.3 in relation to the inlet surface area (S11) of the inner partial diffuser, and the outlet surface area (S12) of the inner partial diffuser corresponds over the entire rotation of the three-channel diffuser to half of the surface area in the dividing plane between the upper half and lower half of the exhaust steam housing that is formed by an impact wall, the hood of the exhaust steam housing, and the guide plate between the inner and middle partial diffuser and the exhaust steam guide plate.

15. The axial/radial three-channel diffuser as claimed in claim 12, wherein the outlet surface area (S12') of the inner partial diffuser in the upper half of the diffuser has a ratio of approximately 1.8 in relation to the inlet surface area (S11) of the inner partial diffuser, and the outlet surface area (S12') of the inner partial diffuser in the upper half of the diffuser corresponds over the entire rotation of the three-channel diffuser approximately to half of the surface area in the dividing plane between the upper half and lower half of the exhaust steam housing that is formed by an impact wall and a hood of the exhaust steam housing, by the exhaust steam guide plate as well as by an axial line extending from the exhaust steam guide plate to a wall of the exhaust steam housing that faces towards the turbine, and over the entire rotation, the sum of the outlet surface area (S22) of the middle partial diffuser and the outlet surface area (S32) of the outer partial diffuser approximately corresponds to half of the surface area in the dividing plane between the upper and lower half of the exhaust steam housing formed by the exhaust steam guide plate, the wall of the exhaust heat housing facing the turbine, and by the axial line from the exhaust steam guide plate to the wall facing the turbine.

16. The axial/radial three-channel diffuser as claimed in claim 12, wherein the total outlet surface area of the three-channel diffuser is approximately 15% smaller than the outlet surface area of the exhaust steam housing.

17. The axial/radial three-channel diffuser as claimed in claim 1, wherein a distance between leading edges of the guide plates and a trailing edge of a last rotating blade row is a minimum distance sufficient to prevent the last rotating blades from contacting the guide plates under thermal expansion conditions during operation.

18. The axial/radial three-channel diffuser as claimed in claim 1, wherein a distance between leading edges of the guide plates and a trailing edge of a last rotating blade row is about 4% of a total height $h_W$ of the last rotating blade row.

* * * * *